US010870032B2

(12) United States Patent
Bardakci

(10) Patent No.: US 10,870,032 B2
(45) Date of Patent: Dec. 22, 2020

(54) GRIPEDO PORTABLE AND MULTIFUNCTIONAL EXERCISE DEVICE

(71) Applicant: Hakan Bardakci, Clarksburg, MD (US)

(72) Inventor: Hakan Bardakci, Clarksburg, MD (US)

( * ) Notice: Subject to any disclaimer, the term of this patent is extended or adjusted under 35 U.S.C. 154(b) by 92 days.

(21) Appl. No.: 16/155,526

(22) Filed: Oct. 9, 2018

(65) Prior Publication Data

US 2019/0105528 A1 Apr. 11, 2019

Related U.S. Application Data

(63) Continuation-in-part of application No. 29/648,188, filed on May 18, 2018, now Pat. No. Des. 861,086.

(60) Provisional application No. 62/569,967, filed on Oct. 9, 2017.

(51) Int. Cl.

| | |
|---|---|
| ***A63B 21/00*** | (2006.01) |
| ***A63B 21/072*** | (2006.01) |
| ***A63B 21/012*** | (2006.01) |
| ***A63B 23/16*** | (2006.01) |
| ***A63B 23/14*** | (2006.01) |
| ***A63B 23/12*** | (2006.01) |

(52) U.S. Cl.

CPC ..... *A63B 21/4035* (2015.10); *A63B 21/0004* (2013.01); *A63B 21/012* (2013.01); *A63B 21/072* (2013.01); *A63B 21/0728* (2013.01); *A63B 21/4049* (2015.10); *A63B 23/14* (2013.01); *A63B 23/16* (2013.01); *A63B 21/0724* (2013.01); *A63B 23/12* (2013.01); *A63B 2210/50* (2013.01)

(58) Field of Classification Search

CPC ..... A63B 15/00–02; A63B 21/0084; A63B 21/0088; A63B 21/4035; A63B 23/14–16; A63H 27/005

See application file for complete search history.

(56) References Cited

U.S. PATENT DOCUMENTS 3,190,033 A * 6/1965 Wood ..... A63H 27/005 446/14
3,803,751 A * 4/1974 Pippin, Jr. ..... A63H 27/005 446/211
4,416,451 A * 11/1983 Solloway ..... A63B 21/00061 482/111
5,449,333 A * 9/1995 Carter ..... A63B 15/00 482/107

(Continued)

*Primary Examiner* — Jennifer Robertson

(57) ABSTRACT

The Gripedo device is a portable and multifunctional exercise apparatus that can be used alone or together with a variety of existing equipment. The Gripedo device includes a handle, a shaft and a plurality of fins. The handle, in various shapes and configurations, allows wrenching and twisting like motions of the supination and pronation of the hands, wrists, forearms, and internal and external rotation of shoulders. The user can also grip the shaft and conduct a variety of sport specific hold training. The user can also grip the shaft to perform wrist extensions and flexions or the handle to perform wrist extensions, wrist flexions, wrist ulnar deviation and wrist radial deviation. The plurality of fins on the shaft can be mounted to an existing apparatus or a weight. The Gripedo device can further be used with working against sand, rice, or similar granular material, can be used as gymnastic canes, for dips, pull-ups or push-ups, sled drags, single-arm deadlifts or carries, exercises using landmines, therapeutic exercises, goblet squats, sled, hammer-like wrist leveraging exercises, etc.

20 Claims, 14 Drawing Sheets

(56) References Cited

U.S. PATENT DOCUMENTS 5,653,216 A * 8/1997 Johnson ..... A63H 27/005 124/69
6,071,214 A * 6/2000 Osterman ..... A63B 23/14 482/44
D450,793 S * 11/2001 Dantolan ..... D21/680
6,568,985 B1 * 5/2003 Binkley ..... A63H 27/005 446/176
6,752,682 B1 * 6/2004 Ferrell ..... A63H 27/005 124/16
8,157,709 B2 * 4/2012 Wilkinson ..... A63B 21/00069 482/108
2002/0086610 A1 * 7/2002 LaPointe ..... A63H 27/005 446/400
2002/0165070 A1 * 11/2002 Pullaro ..... A63B 15/00 482/109
2003/0064658 A1 * 4/2003 Zheng ..... A63H 27/005 446/220
2003/0207719 A1 * 11/2003 Hughes ..... A63B 15/00 473/228
2004/0116256 A1 * 6/2004 Stout ..... A63B 21/0084 482/55
2005/0215339 A1 * 9/2005 Namba ..... A63B 21/0088 473/228
2009/0104839 A1 * 4/2009 Chang ..... A63H 27/005 446/212
2010/0056288 A1 * 3/2010 Baker ..... A63B 69/3608 473/213
2012/0149539 A1 * 6/2012 Quader ..... A63B 21/00072 482/109
2014/0113752 A1 * 4/2014 Westcott ..... A63B 69/0002 473/422
2014/0364247 A1 * 12/2014 Corcoran ..... A63B 21/0088 473/228
2017/0128849 A1 * 5/2017 Howell ..... A63H 27/005
2018/0250568 A1 * 9/2018 Heusman ..... A63B 69/0002
2019/0184256 A1 * 6/2019 Mainini ..... A63B 69/00

* cited by examiner

GRIPEDO PORTABLE AND MULTIFUNCTIONAL EXERCISE DEVICE

The current application claims a priority to the U.S. Provisional Patent application Ser. No. 62/569,967 filed on Oct. 9, 2017.

FIELD OF THE INVENTION

The present invention relates generally to exercise equipment and multifunctional devices. More specifically, the present invention relates to a portable and multifunctional exercise device for a user to work hands, wrists, forearms, shoulders, chest, bicep and tricep muscles, and the upper extremities.

BACKGROUND OF THE INVENTION

Exercise equipment are essential tools for people who desire to work out and exercise their body. Exercise equipment include a wide range of devices ranging from plates and barbells to bench presses and exercise machines. Exercise equipment may include devices to exercise the upper extremities including, but not limited to, wrists, forearms, shoulders, and even chest muscles. Exercise equipment such as wrist rollers are equipment which target the muscles and joints on the hands, wrists, forearms, etc. Wrist rollers and other similar devices are used by mounting them on an existing frame or structure which provides elongated cylindrical protrusions. While mounted, the wrist roller and other similar devices are twisted or rotated to allow wrist extension and wrist flexion, but not wrenching exercises. In addition, a weight or heavy object is attached to the wrist roller or similar device to further provide resistance to the twisted or rotating motion being applied to the device by the user. Some wrist rollers or similar devices can be further used without having to mount them on a frame or structure to perform other exercises. Unfortunately, most of the existing wrist rollers and similar devices do not provide the flexibility of being used for a wide range of exercises, such as being used as gymnastic canes, be used to work against sand, or be used as pull-up handles, push-up handles, deadlift handles, or Goblet Squat handles. In addition, most of the existing wrist rollers only allow wrist flexion and extension and do not allow wrenching-like movements with weights attached which allow user to perform supination pronation of wrists, forearms, and shoulder internal and external rotations. Thus, a portable and multifunctional device to exercise the upper-extremities which can be used with existing frames or structures and can further be used for a wide range of exercises is beneficial and necessary.

An objective of the present invention is to provide a portable and multifunctional exercise device which allows a user to perform exercise to work out hands, wrists, forearms, shoulders, triceps, biceps, back, and even chest muscles. Another objective of the present invention is to provide a portable and multifunctional exercise device which can be used with existing frames or structures found in exercise areas. Another objective of the present invention is to provide a portable and multifunctional exercise device which can be used for exercise activities that do not require an existing frame or structure found in exercise areas. Another objective of the present invention is to provide a portable and multifunctional exercise device which allows the user to perform concentric contraction training which causes less muscle damage and permits quick recovery. Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

SUMMARY OF THE INVENTION

The present invention is a portable and multifunctional exercise device also known as the Gripedo Device. The present invention can be used by mounting the portable and multifunctional exercise device to a barbell which is in a squat or bench press rack or a power rack frame which has a plate holder on the side. The ball handle of the present invention allows wrenching-like motions of the supination and pronation of the wrists, forearms, and shoulder internal and external rotations. The user can also grip the Gripedo device and do wrist extensions and flexions and roll up and down the weight. More specifically, the user can either grip the shaft of the present invention or grip the shaft using one hand and the handle using the other, which provides a convenient and efficient exercise option to the user that most existing wrist rollers lack. The Gripedo device comprises a plurality of fins on the shaft opposite the handle with a hole to receive a string or any other attachment element hooked to an existing machine or a weight. The Gripedo device can further be used with working against sand, rice, or similar granular material, can be used as gymnastic canes, for dips, as pull-up handles or push-up handles, for single-arm deadlifts or carries, for exercises using landmines, for therapeutic exercises, goblet squats, sled applications, etc. The Gripedo device is portable and versatile with various uses.

DETAIL DESCRIPTIONS OF THE INVENTION

Figure 1:
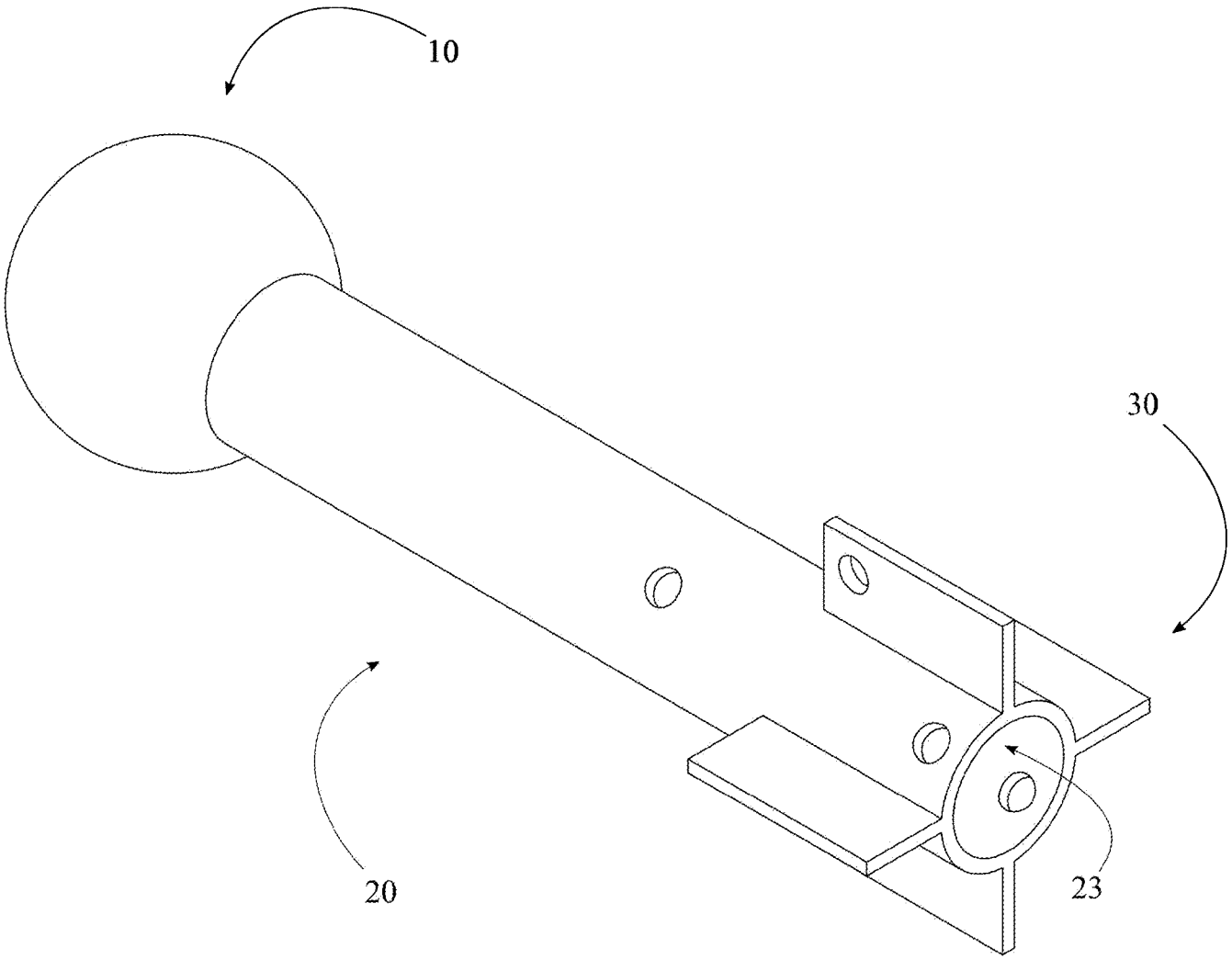
FIG. 1 is an isotropic perspective view of the present invention showing the Gripedo device. The ball handle is shown attached to an end of the shaft.

All illustrations of the drawings are for the purpose of describing selected versions of the present invention and are not intended to limit the scope of the present invention.

The present invention is a portable and multifunctional exercise device also known as the Gripedo device. The present invention, Gripedo portable and multifunctional exercise device, can be mounted on to an end of a barbell which is in a squat, bench press rack, power rack frame, or similar structure having a cylindrical protrusion. The user exercises using the Gripedo portable and multifunctional exercise device by gripping the handle, and/or the shaft to perform wrist extension, wrist flexion, forearm supination, forearm pronation, wrist supination, wrist pronation, wrist ulnar deviation, wrist radial deviation, and internal and external shoulder rotation.

In the preferred embodiment of the present invention, as seen in FIGS. 1-3, and 14, the Gripedo device comprises a handle 10, a shaft 20, and a plurality of fins 30. The handle 10 of the Gripedo device can be a variety of shapes and sizes. The preferred embodiment of the handle 10 comprises a ball handle 11 which can be a solid or hollow ball and is terminally connected to the shaft 20. Additionally, the handle 10 can be various shapes including, but not limited to, barbell, hub, cylinder, wheel, dome, etc. The handle 10 provides the user a convenient and efficient means to hold the present invention and work muscles in various exercises. The shaft 20 comprises an elongated shaft body 21, which is used to connect the handle 10 and the plurality of fins 30 to the shaft body 21. Additionally, the shaft body 21 comprises a first distal end 211 and a second distal end 212. The handle 10 is terminally connected to the shaft body 21 at the first distal end 211. The shaft body 21 includes, but is not limited to, a solid bar, a rod, a hollow tube, or any other suitable shape and material. The plurality of fins 30 is terminally and exteriorly positioned on the shaft body 21, flush with the second distal end 212 of the shaft body 21. More specifically, each of the plurality of fins 30 is oriented perpendicular to the outer surface of the shaft body 21. The plurality of fins 30 includes, but is not limited to, a rectangular shape. Each of the plurality of fins 30 allows the user to perform wrenching and twisting like exercises by supinating or pronating the wrist and forearm when the user inserts the shaft 20 of the Gripedo device into sand, rice, or any other suitable granular material contained in a container. The user can hold and rotate the handle 10, or the shaft body 21 and work against sand, rice, or any other suitable granular material. Additionally, the user can hold and rotate the shaft body 21 and work against sand, rice, or any other suitable granular material, and this type of exercise and training replicates a specific holding position for sports such as golf, batt, tennis, lacrosse, etc. The preferred embodiment of the present invention allows the user to work out in a specific sport type hold that uses hands, wrists, forearms shoulders, biceps, triceps, core muscles, etc. Thus, the user can effectively work not only forearm supination and pronation, but also shoulder internal and external muscles.

Figure 2:
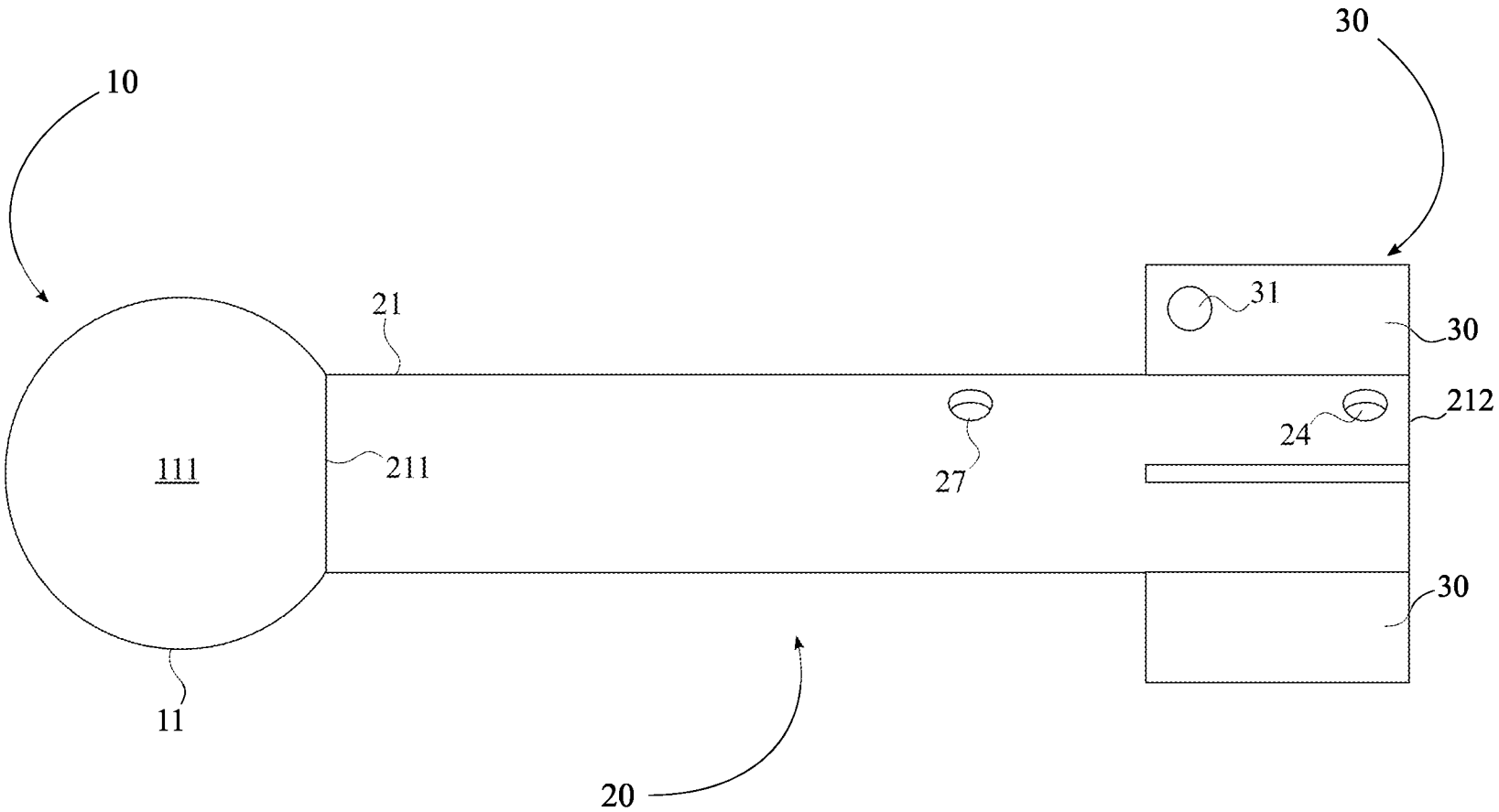
FIG. 2 is a top view of the present invention showing the Gripedo device. The plurality of fins is shown attached to an end of the shaft.
Figure 3:
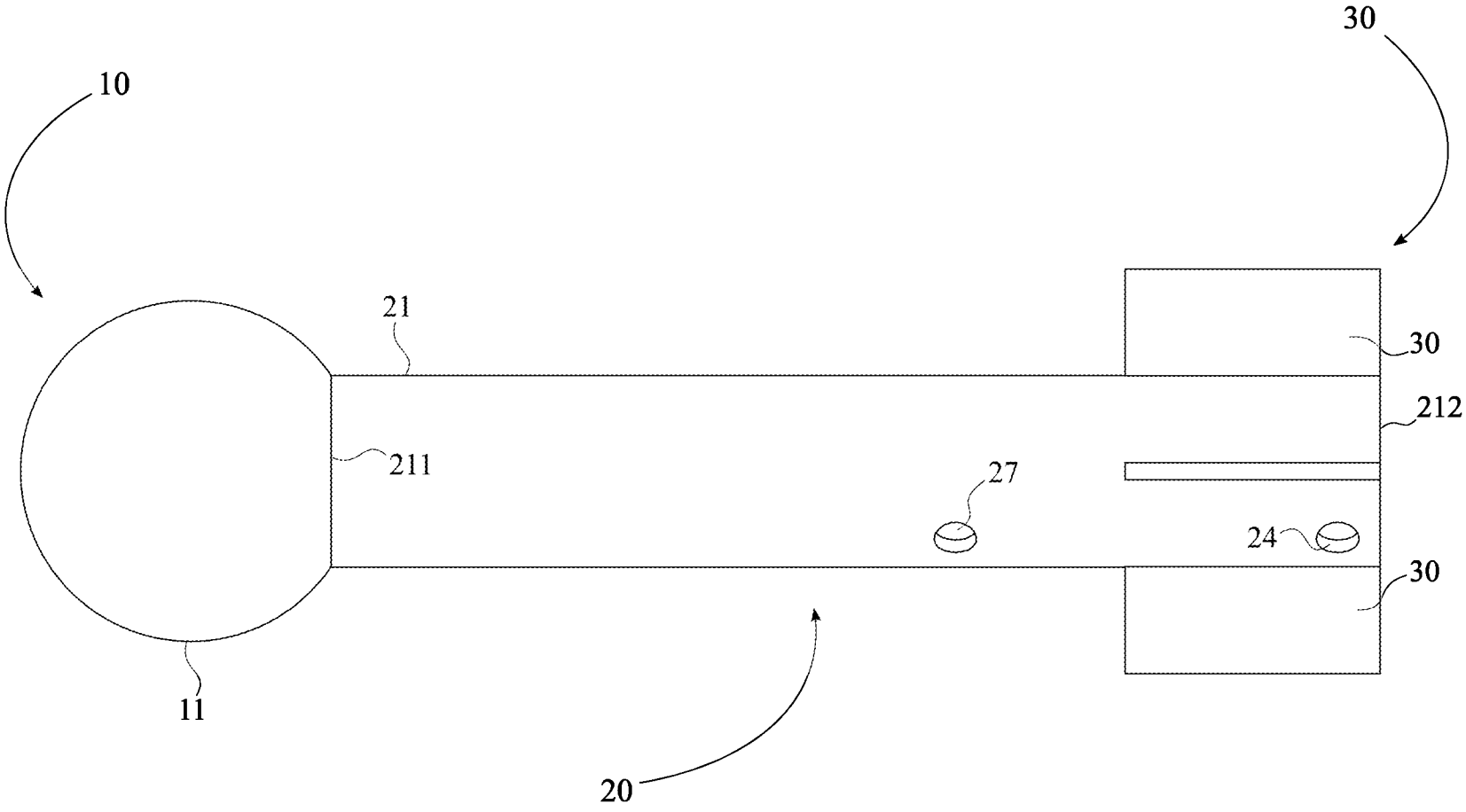
FIG. 3 is a side view of the present invention showing the Gripedo device. The plurality of orifices on the shaft is shown.
Figure 4:
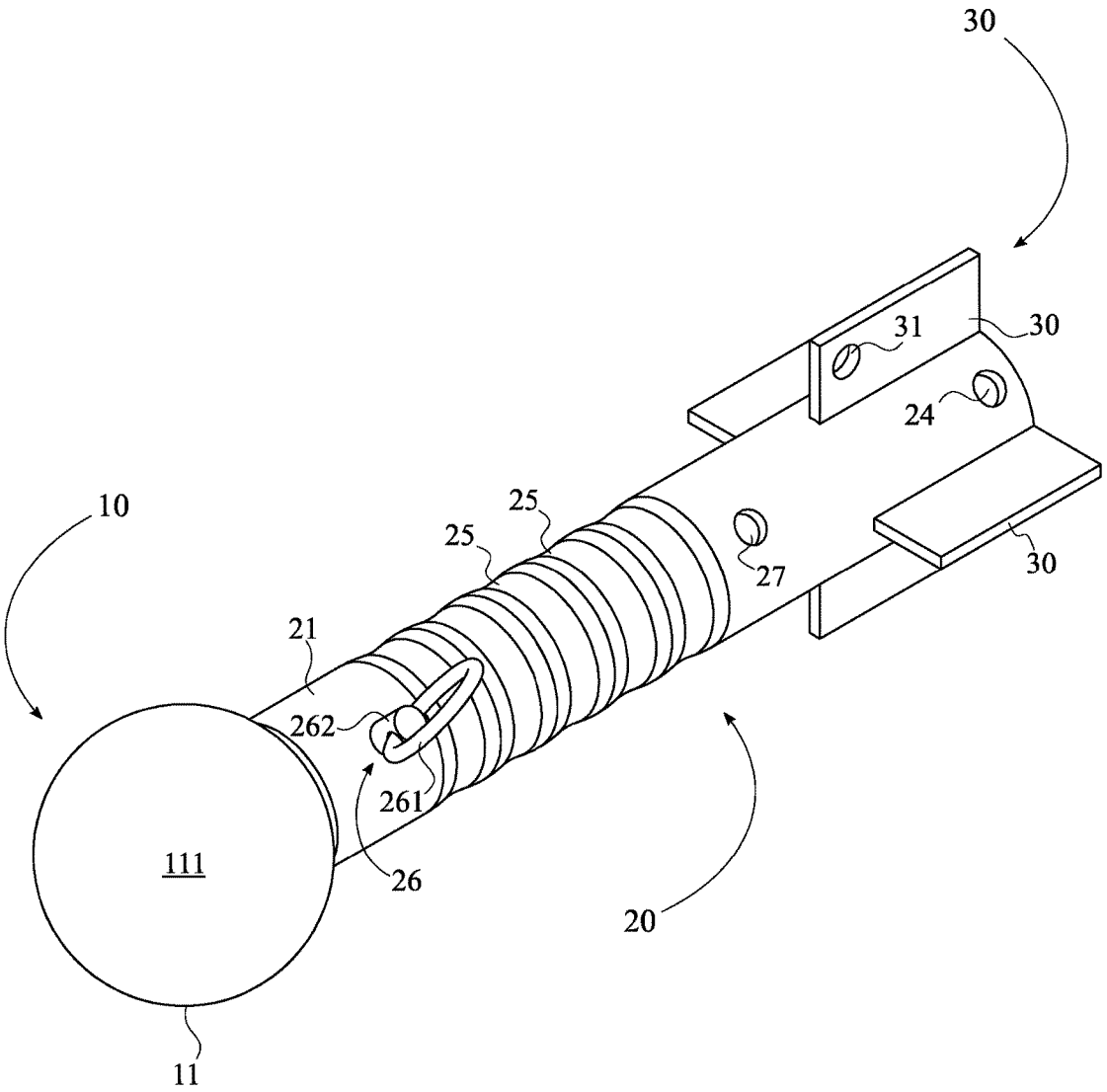
FIG. 4 is an isotropic perspective view of an embodiment of the present invention showing the Gripedo device. The ball handle is shown attached to an end of the shaft through a hitch pin.
Figure 5:
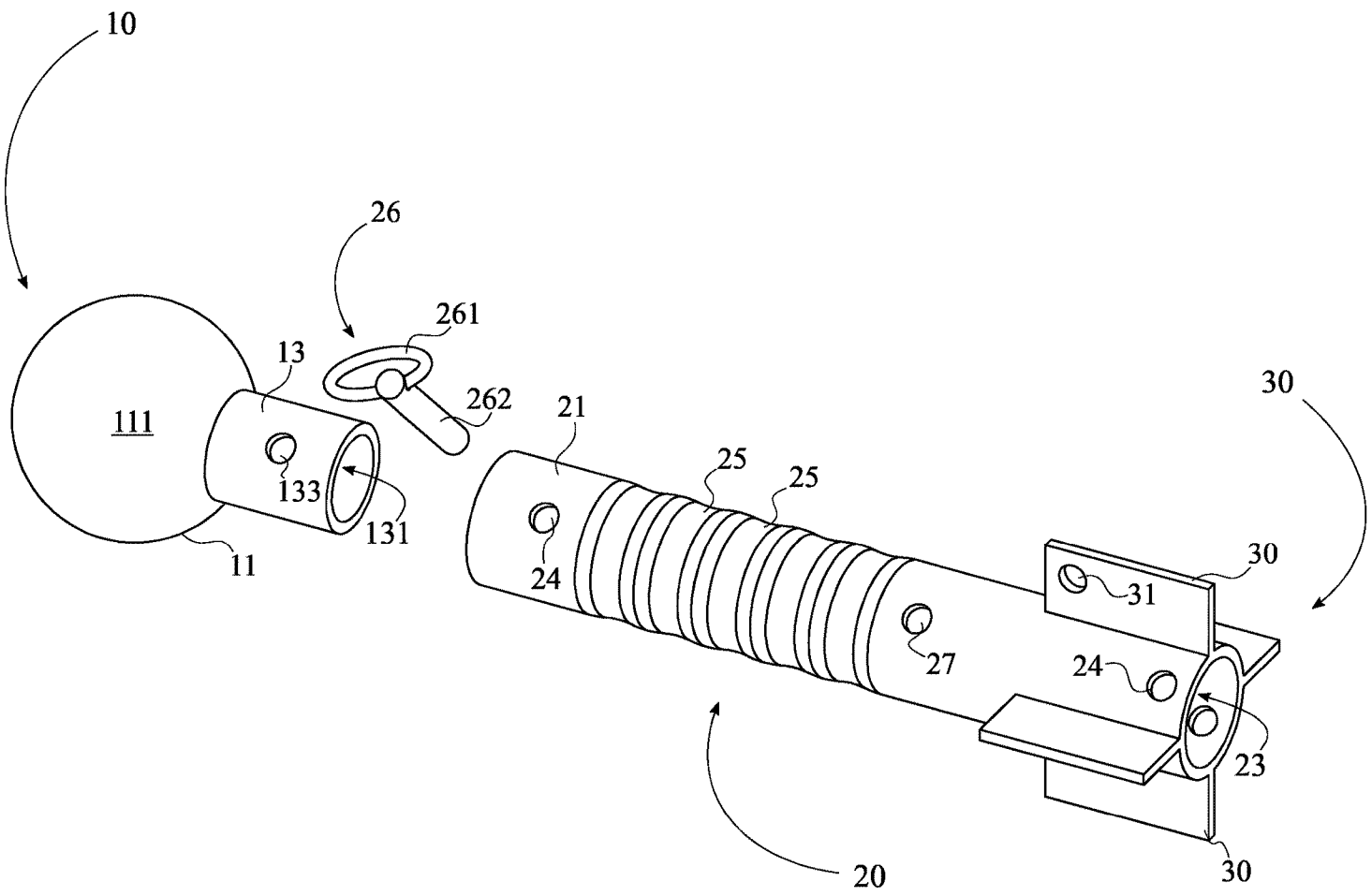
FIG. 5 is an exploded view of an embodiment of the present invention showing the Gripedo device. The ball handle is shown to be attached to an end of the shaft through a hitch pin.
Figure 6:
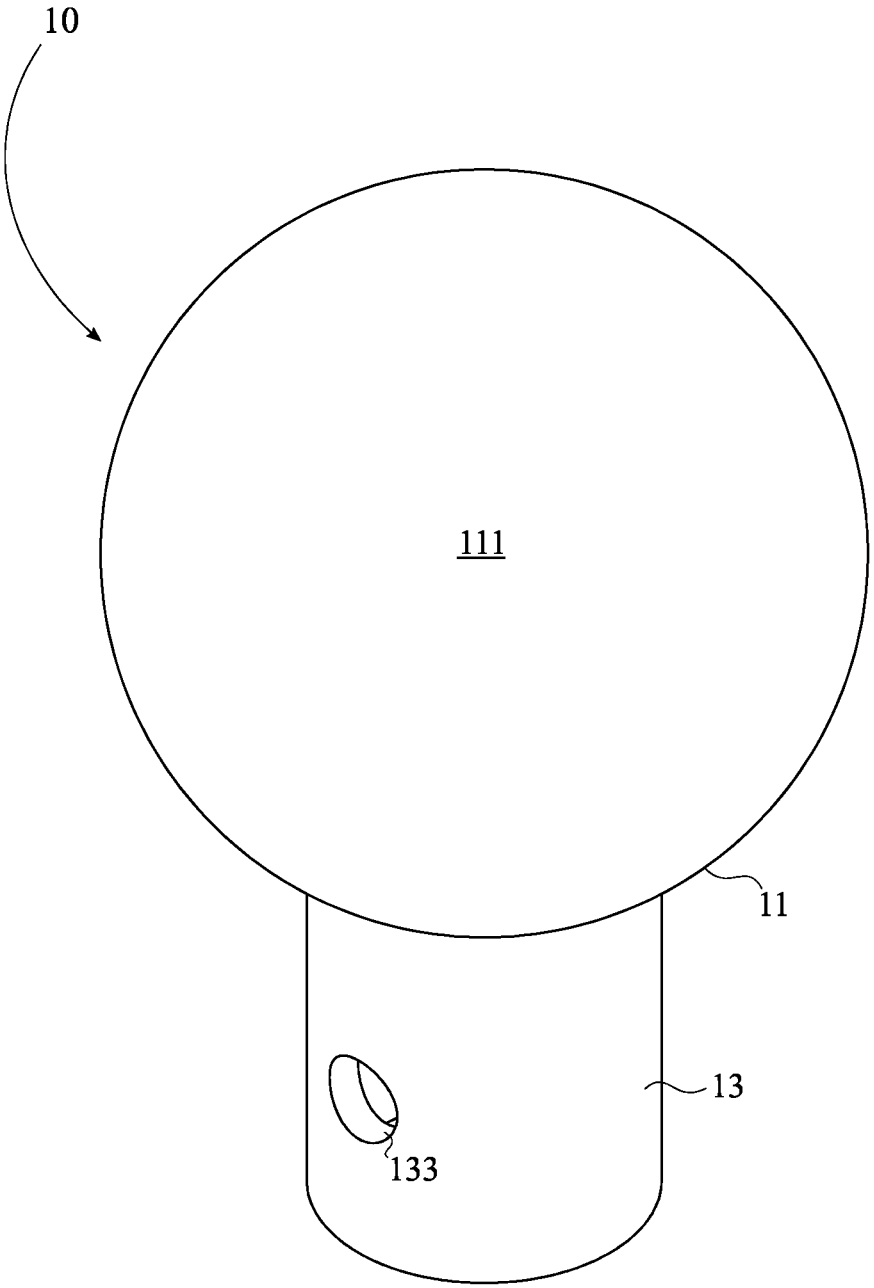
FIG. 6 is a front view of an embodiment of the present invention showing the ball handle that can be attached to an end of the shaft through the hole.

In the preferred embodiment of the present invention, the shaft 20 is a hollow tube and further comprises a first opening 22, a second opening 23, a plurality of holes 24, and a threaded hole 27 as seen in FIGS. 1-3, and 14. The first opening 22 is positioned at the first distal end 211 and the second opening 23 is positioned at the second distal end 212. The plurality of holes 24 is positioned across the shaft body 20 adjacent the first opening 22 and the second opening 23. More specifically, the plurality of holes 24 traverses through and intercepts the shaft body 21, as seen in FIGS. 2-3. The plurality of holes 24, together with the second opening 23, are used to connect the shaft 20 to various existing exercise machines and apparatuses for the user to conduct multifunctional exercises. The threaded hole 27 is terminally and exteriorly positioned on the shaft body 21 between the first opening 22 and the plurality of fins 30. More specifically, the threaded hole 27 provides an efficient means for the user to connect the present invention to an existing exercise machine, frame, and/or device using common fasteners including, but not limited to, a star knob screw to perform a variety of exercises. Furthermore, the plurality of fins 30 comprises at least one hole 31, and the at least one hole 31 is positioned on at least one of the plurality of fins 30. The at least one hole 31 further traverses through the at least one of the plurality of fins 30. The at least one hole 31 provides a mechanism for the user to attach the Gripedo device to exercise weights, or a variety of existing exercise machines in an exercise area through common attachment elements including, but not limited to, string, rope, cable, chain, steel wire, etc.

As can be seen in FIGS. 4-6 and 13-14, in one embodiment of the present invention, the shaft 20 of the Gripedo device, further comprises a gripping portion 25 and a plurality of hitch pins 26. The gripping portion 25 is concentrically and terminally positioned on shaft body 21. Additionally, the gripping portion 25 is positioned exteriorly on the shaft body 21 between the first distal end 211 and the second distal end 212. The gripping portion 25 can include, but is not limited to, a plurality of grooves, ridges, sleeves, coatings, or any other suitable elements to provide the user a firm grippable surface for a variety of exercises. In other embodiments of the present invention, the shaft body 21 may include any suitable coated material, and/or sleeve to enhance the grip of the user's hand during exercise. The plurality of hitch pins 26 is a common connector that is used to connect the handle 10 to the shaft 20, and to attach the shaft 20 to any other machine/device the user chooses for desired exercise. More specifically, each of the plurality of hitch pins 26 comprises a ring 261 and a pin 262. The pin 262 is used to make the connection securely and the ring 261 provides the user a convenient means to efficiently install and uninstall the corresponding components. In other embodiments of the present invention, any suitable plurality of connectors or fasteners can be used in place of the plurality of hitch pins 26.

As can be seen in FIGS. 4-6 and 13-14, in one embodiment of the present invention, the handle 10 of the Gripedo device, comprises the handle body 11 and a handle connector 13. The handle body 11 comprises a ball handle 111. The ball handle 111 includes, but not limited to, a hollow ball and can be configured to have grip coatings, grip sleeves, or grooves for an effectively grippable outer surface. The ball handle connector 13 comprises an opening 131 and a plurality of holes 133. More specifically, the handle connector 13 is terminally connected to the ball handle 111. The opening 131 of the handle connector 13 is positioned opposite the ball handle 111 along the handle connector 13. The plurality of holes 133 is terminally and exteriorly positioned on the handle connector 13 adjacent to the opening 131. Additionally, the plurality of holes 133 traverses through and intersecting the handle connector 13. The handle connector 13 connects the handle body 11 to the shaft 20 through one of the plurality of holes 133 using one of the plurality of hitch pins 26. This type of configuration with the handle body 11 being connected to the shaft 20 through the handle connector 13 and the plurality of hitch pins 26 provides the user a convenient and efficient interchange of the handle 10 for a variety of exercises, and thus making the present invention, the Gripedo device, a substantially multifunction body training apparatus. The ball handle 111 provides the user various exercises including, but not limited to, wrist extension, wrist flexion, forearm supination, forearm pronation, wrist supination, wrist pronation, wrist ulnar deviation, wrist radial deviation, and internal and external shoulder rotation.

Figure 7:
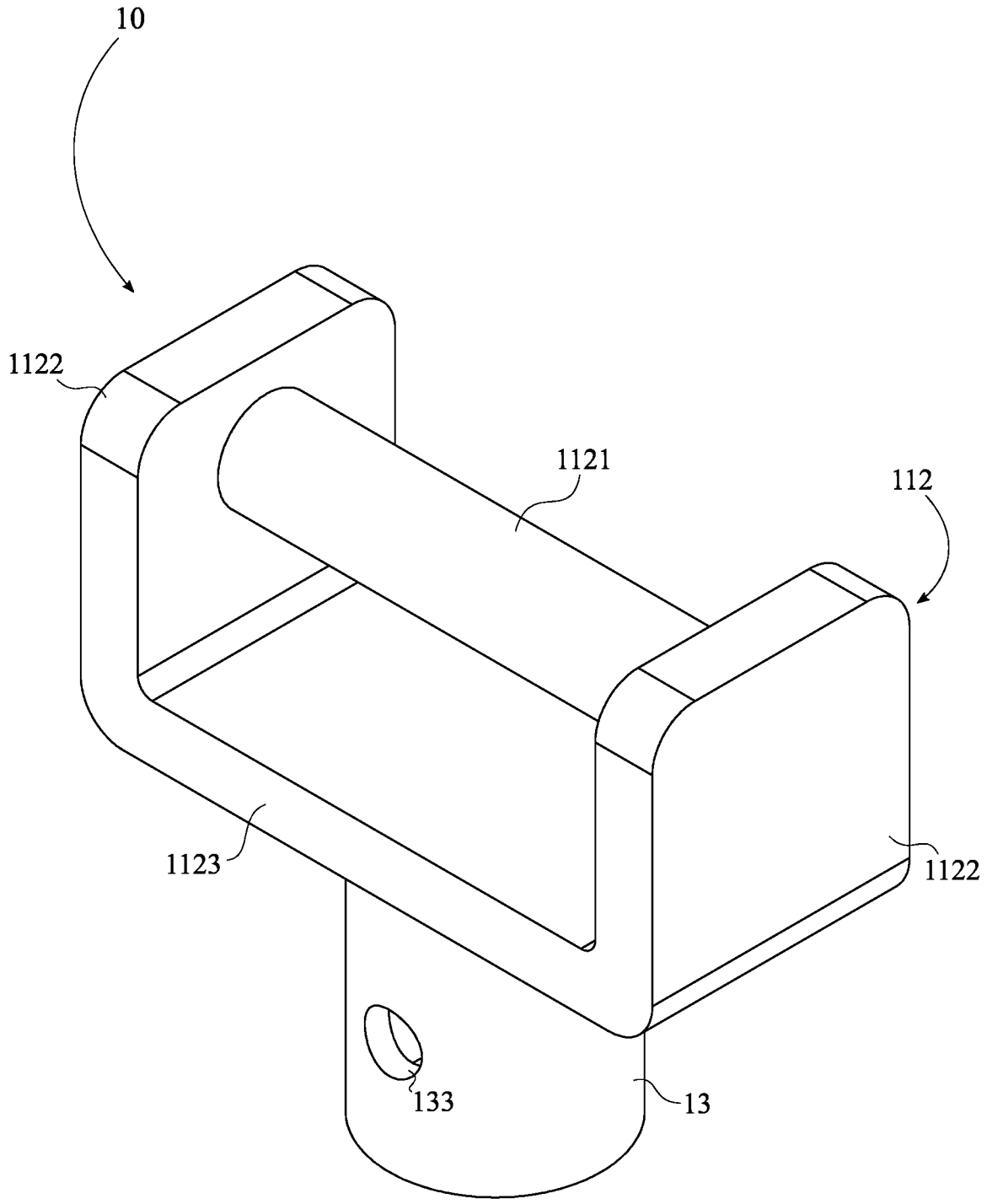
FIG. 7 is an isotropic perspective view of another embodiment of the present invention showing a bar handle that can be attached to an end of shaft through the hole.

In another embodiment of the present invention, as seen in FIG. 7, the handle 10 comprises a bar handle 112. The bar handle 112 further comprises a bar 1121, a plurality of support walls 1122, and a base block 1123. More specifically, the bar 1121 is terminally connected and oriented perpendicular to the plurality of support walls 1122. The bar 1121 can be a solid bar, or a hollow tube, or any other suitable element for the alternative embodiments. The plurality of support walls 1122 is terminally connected and oriented perpendicular to the base block 1123. The base block 1123 is oriented parallel to the bar 1121 and terminally connected to the handle connector 13. Additionally, the base block 1123 is positioned perpendicular to each of the plurality of support walls 1122. The handle connector 13 is centrally positioned and oriented perpendicular to the base block 1123, opposite the plurality of support walls 1122 along the base block 1123. The bar handle 112, when detachably attached to the shaft 20 using one of the plurality of hitch pins 26, provides the user a variation of grip to the Gripedo device to work various exercises including, but not limited to, wrist extension, wrist flexion, wrist supination, wrist pronation, forearm supination, forearm pronation, shoulder internal rotation, shoulder external rotation, wrist ulnar deviation and wrist radial deviation.

Figure 8:
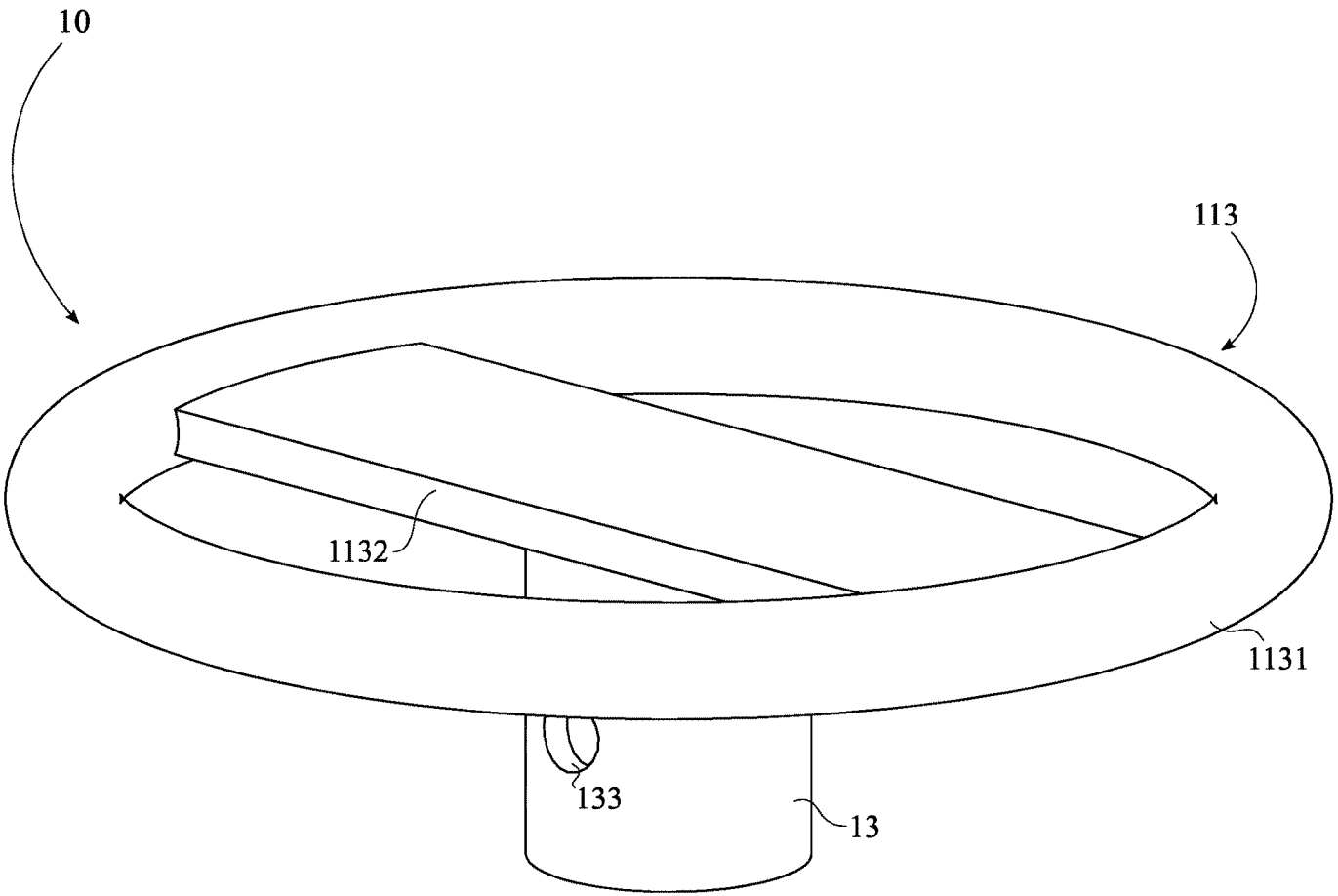
FIG. 8 is an isotropic perspective view of another embodiment of the present invention showing a wheel handle that can be attached to an end of the shaft through the hole.

In another embodiment of the present invention, as seen in FIG. 8, the handle 10 comprises a wheel handle 113. The wheel handle 113 comprises a ring 1131, and a bracket 1132. More specifically, the bracket 1132 is terminally connected to and positioned within the ring 1131. Additionally, the bracket 1132 is aligned with the center of the ring 1131 and terminally connected to the handle connector 13. The handle connector 13 is centrally positioned and oriented perpendicular to the bracket 1132. The wheel handle 113, when detachably attached to the shaft 20 using one of the plurality of hitch pins 26, provides the user another variation of exercise using the Gripedo device to conduct exercises including, but not limited to, wheel rotating like exercises.

Figure 9:
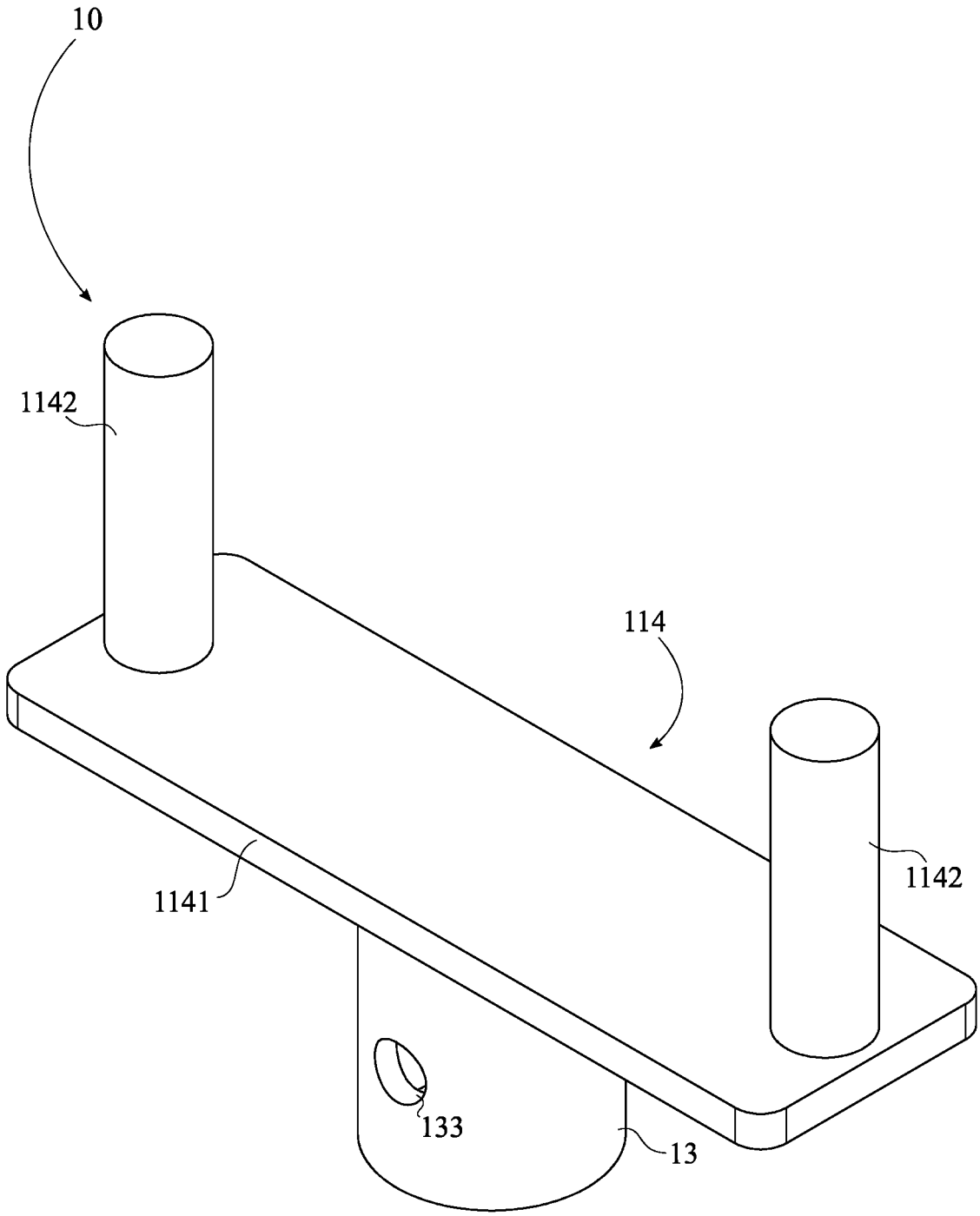
FIG. 9 is an isotropic perspective view of another embodiment of the present invention showing a rotary bar handle that can be attached to an end of the shaft through the hole.

In another embodiment of the present invention, as seen in FIG. 9, the handle 10 comprises a rotary bar handle 114. The rotary bar handle 114 further comprises a plate 1141 and a plurality of bars 1142. More specifically, the plurality of bars 1142 is distributed across and oriented perpendicular to the longitudinal centerline of the plate 1141. Each of the plurality of bars 1142 can be a solid bar, or a hollow tube, or any other suitable element for the alternative embodiments. Further, the plurality of bars 1142 may be fixed or rotatable in place. The plate 1141 is terminally connected to the handle connector 13. Further, the handle connector 13 is centrally positioned and oriented perpendicular to the plate 1141, opposite the plurality of bars 1142 along the plate 1141. The rotary bar handle 114, when detachably attached to the shaft 20 using one of the plurality of hitch pins 26, provides the user another variation of grip to the Gripedo device to work various exercises including, but not limited to, pushing and pulling exercises which use hands, forearms, back, chest, biceps, and triceps.

Figure 10:
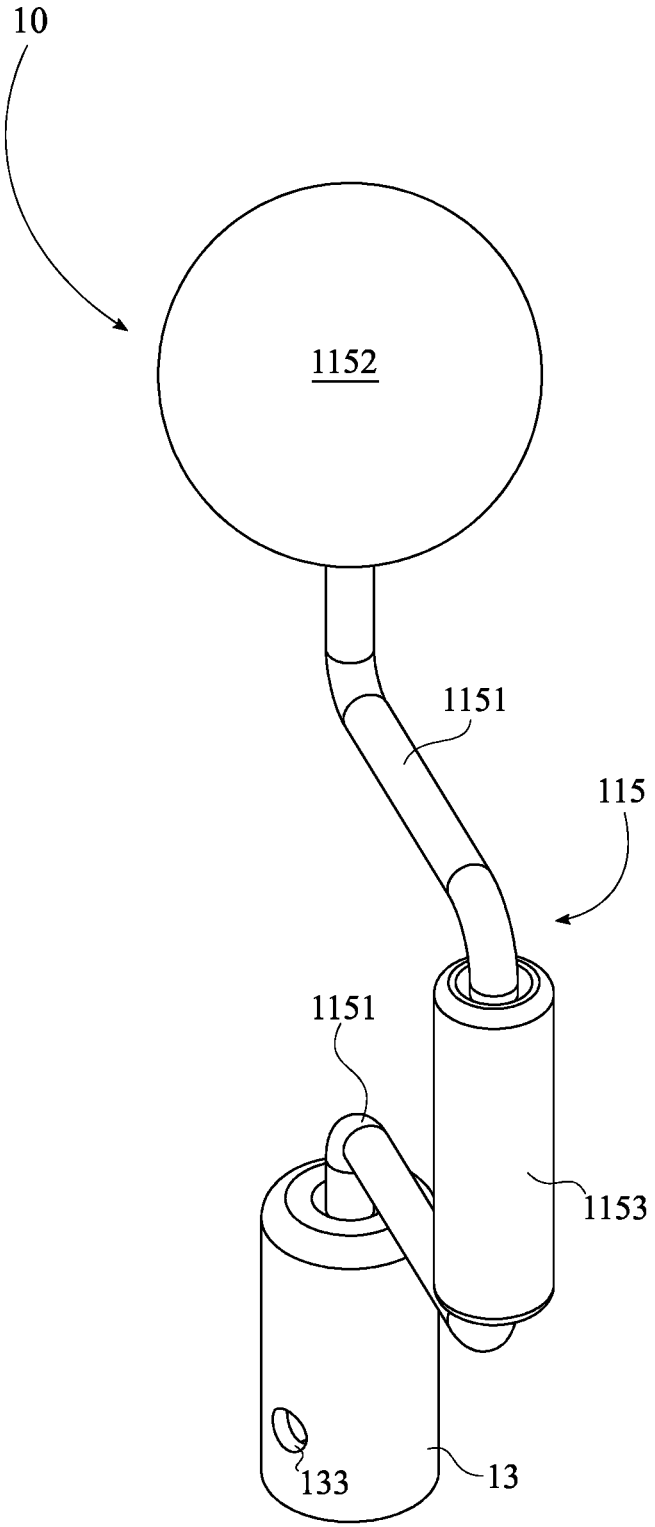
FIG. 10 is an isotropic perspective view of another embodiment of the present invention showing a rotary ball handle that can be attached to an end of the shaft through the hole.

In another embodiment of the present invention, as seen in FIG. 10, the handle 10 comprises a rotary ball handle 115. The rotary ball handle 115 further comprises a plurality of shafts 1151, a ball 1152, and a bar 1153. More specifically, the plurality of shafts 1151 is configured in a U-shape or any other curved shape to connect the ball 1152 and the handle connector 13. The ball 1152 is terminally connected to the plurality of shafts 1151, opposite the handle connector 13. Additionally, the ball 1152 can be a solid or hollow ball and can rotate in place. The bar 1153 is concentrically connected to and positioned in the middle section of the plurality of shafts 1151 and rotates in place. Additionally, each of the plurality of shafts 1151 can be a solid shaft, or a hollow tube, or any other suitable element for the alternative embodiments. Further, the plurality of shafts 1151 is terminally and concentrically connected to the handle connector 13. The rotary ball handle 115, when detachably attached to the shaft 20 using one of the plurality of hitch pins 26, provides the user another variation of grip to the Gripedo device to work exercises including, but not limited to, circular motions with the arms.

Figure 11:
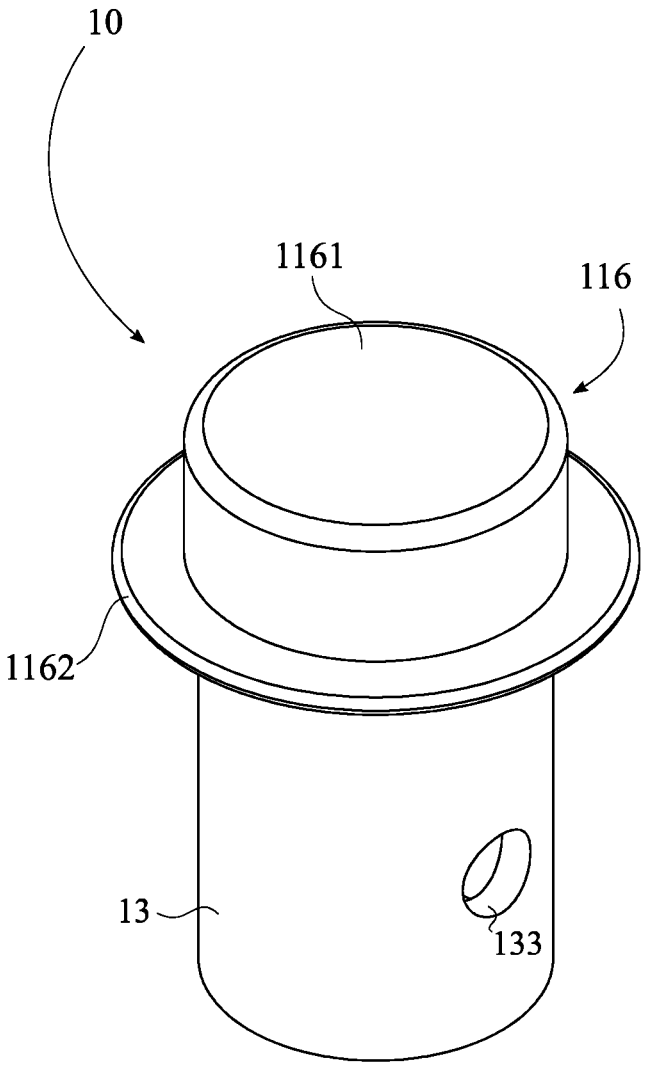
FIG. 11 is an isotropic perspective view of another embodiment of the present invention showing a hub handle that can be attached to an end of the shaft through the hole.

In another embodiment of the present invention, as seen in FIG. 11, the handle 10 comprises a hub handle 116. The hub handle 116 further comprises a hub 1161 and a disk plate 1162. More specifically, the hub 1161 is terminally connected and oriented perpendicular to the disk plate 1162. Additionally, the hub 1161 can be a solid hub, or a shallow and hollow tube, or any other suitable element for the alternative embodiments. The plate 1162 is terminally and concentrically connected to the handle connector 13. Additionally, the disk plate 1162 can be a solid plate, or a hollow plate, or any other suitable element. Further, the handle connector 13 is centrally positioned and oriented perpendicular to the disk plate 1162, opposite the hub 1161.

Figure 12:
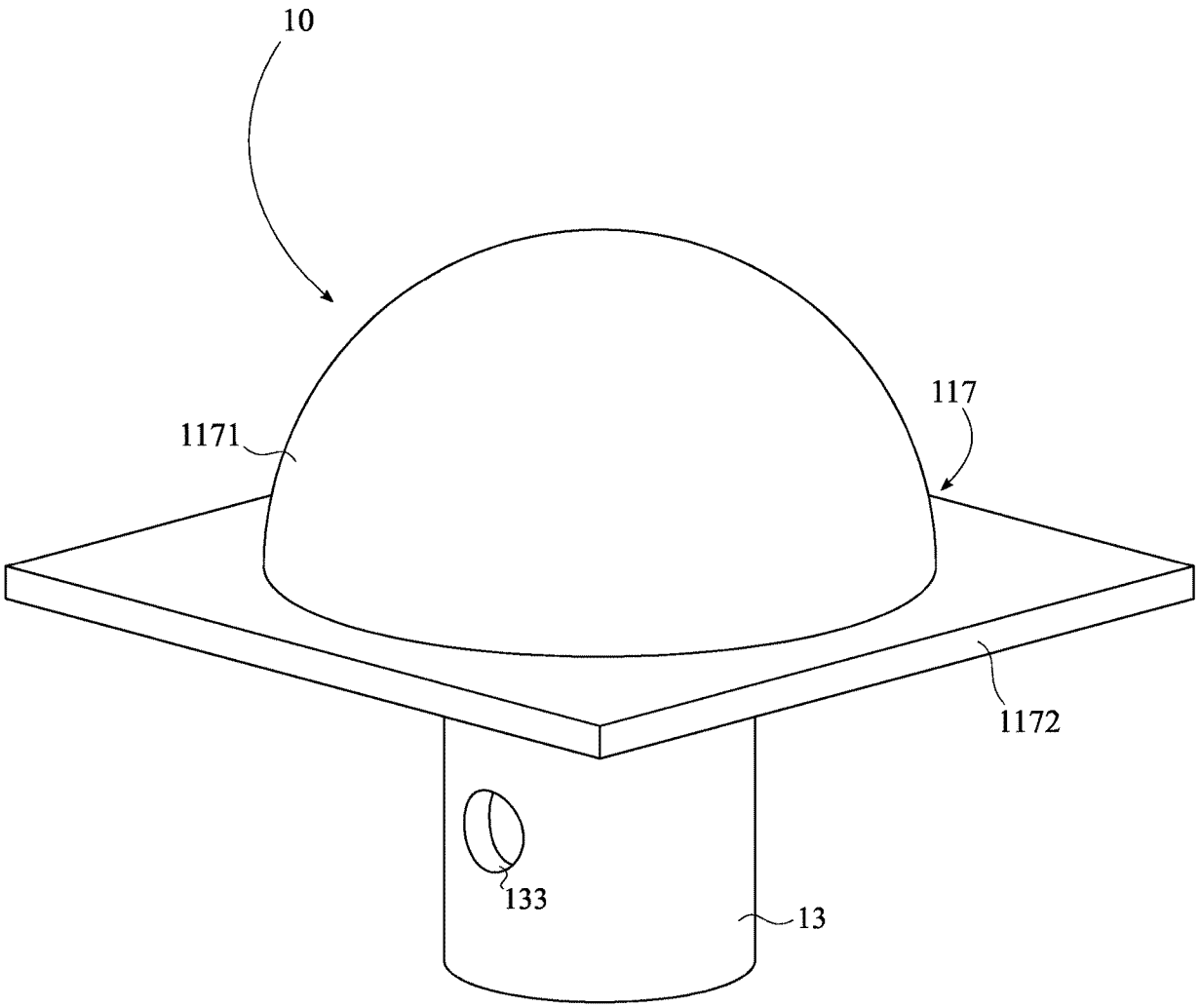
FIG. 12 is an isotropic perspective view of another embodiment of the present invention showing a dome handle that can be attached to an end of the shaft through the hole.

In another embodiment of the present invention, as seen in FIG. 12, the handle 10 comprises a dome handle 117. The dome handle 117 further comprises a dome 1171 and a plate 1172. More specifically, the dome 1171 is terminally connected and oriented perpendicular to the plate 1172. Additionally, the dome 1171 can be a solid semi-dome, or hollow dome, or any other suitable element for the alternative embodiments. The plate 1172 is terminally connected to the handle connector 13. Additionally, the plate 1172 can be a solid plate, or a hollow plate, or any other suitable element and shape. Further, the handle connector 13 is centrally positioned and oriented perpendicular to the plate 1172, opposite the dome 1171.

Figure 13:
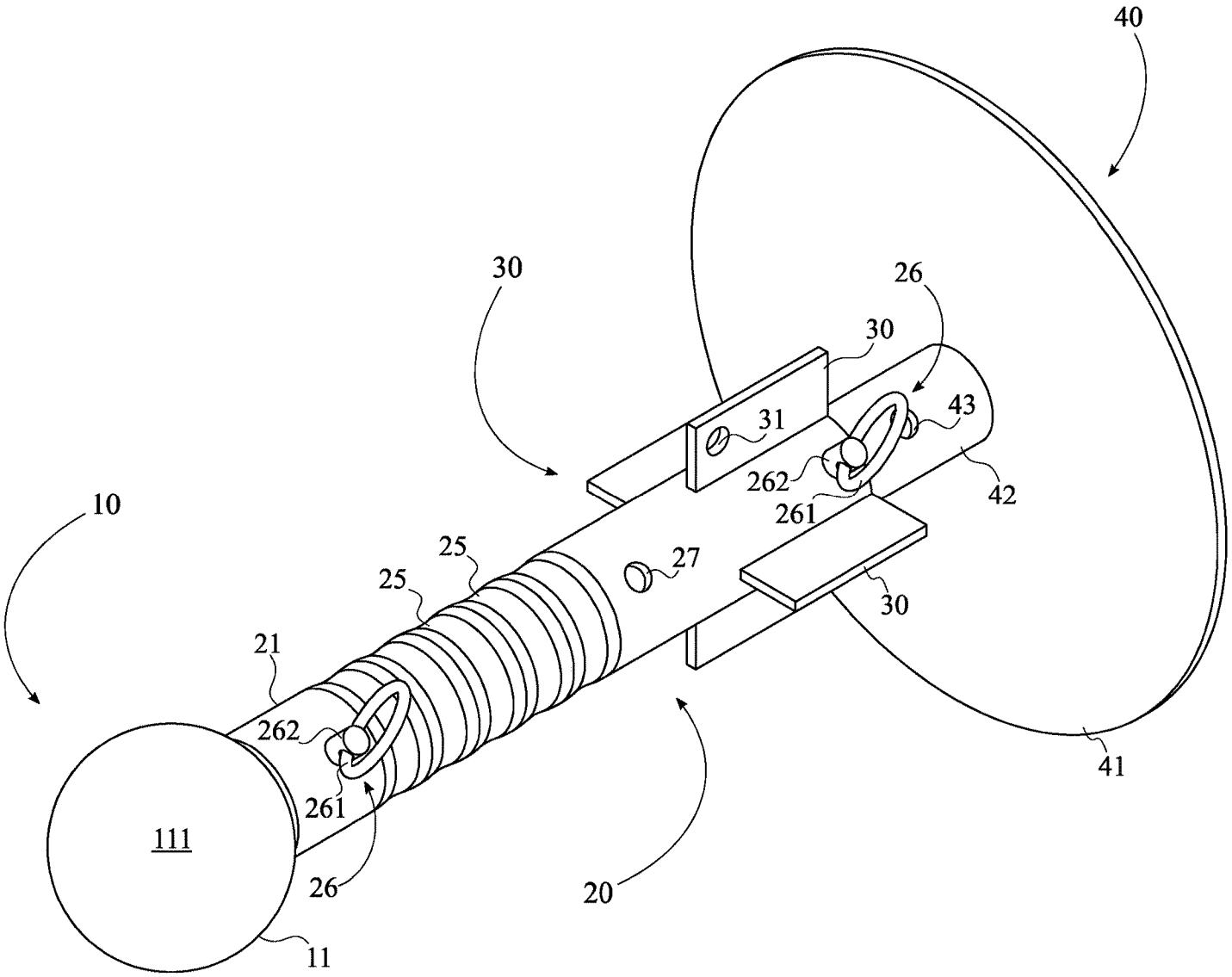
FIG. 13 is an isotropic perspective view of another embodiment of the present invention showing a ball handle that is attached to an end of the shaft through the hole and a weight bearing flange attached to the other end of the shaft.
Figure 14:
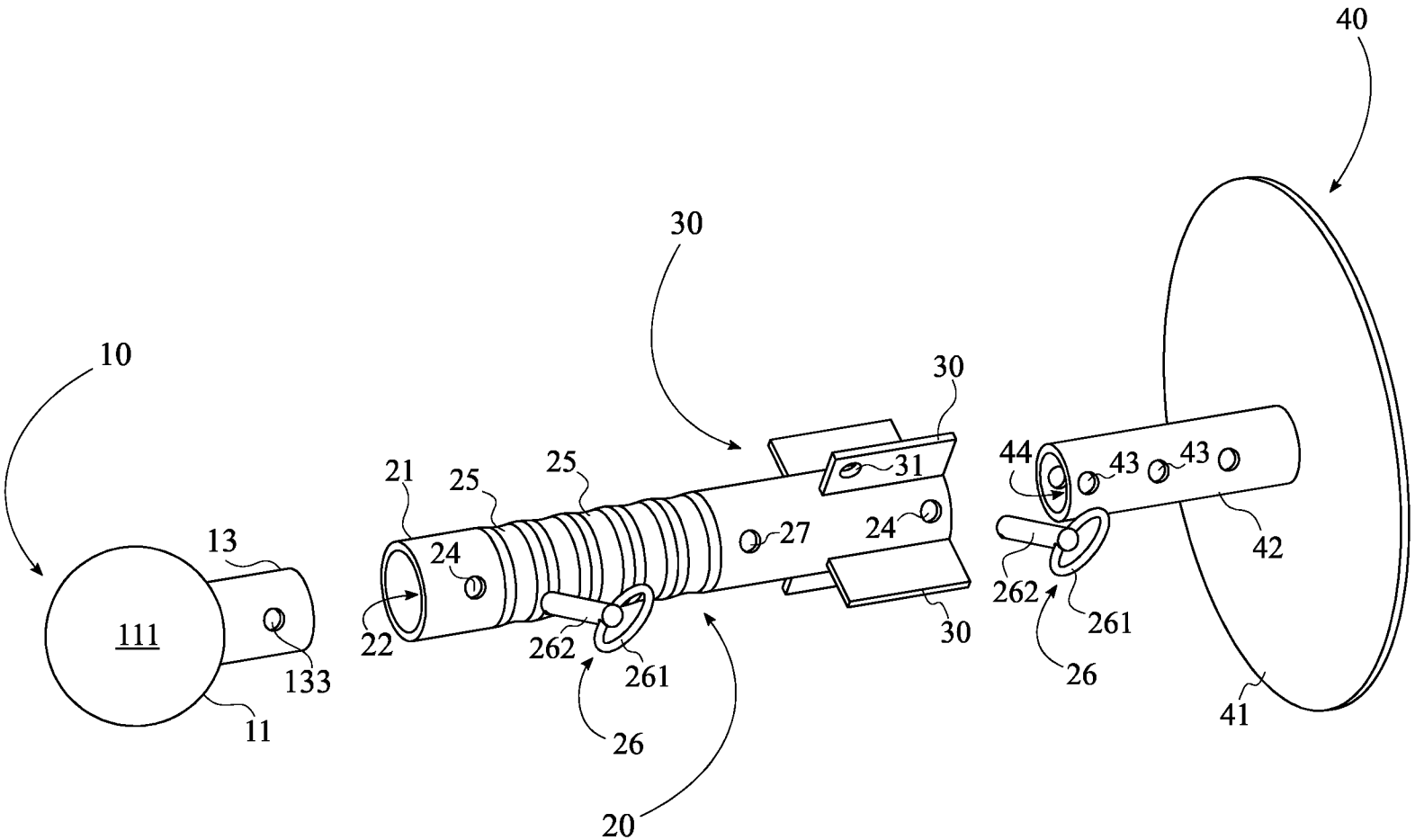
FIG. 14 is an exploded view of the embodiment of the present invention showing the ball handle, the shaft, and the weight bearing flange, all to be connected using hitch pins.

In yet another embodiment of the present invention, as seen in FIGS. 13-14, the Gripedo device comprises a weight bearing flange 40. The weight bearing flange 40 further comprises a flange 41 and a flange connector 42. More specifically, the flange connector 42 is terminally connected and oriented perpendicular to the flange 41. The flange connector 42 is centrally positioned on the flange 41. Additionally, the flange 41 can be a solid plate, disk, or any other suitable shape with flat surfaces to allow the present invention to be used on a flat surface including, but not limited to, turf, grass, matt, carpet or wood floor, etc. Furthermore, the flange connector 42 comprises a plurality of holes 43 and an opening 44. More specifically, the plurality of holes 43 is terminally and exteriorly positioned across the flange connector 42. Additionally, the flange connector 42 can be a hollow pipe, or any other suitable element. The flange connector 42 allows the user to insert a plurality of weights or weight plates onto the flange 41. The user then inserts the flange 40 loaded with the desired weights to the second opening 23 of the shaft 20 through the opening 44 of the flange connector 42. By aligning one of the plurality of holes 43 of the flange connector 42 with one of the plurality of holes 24 of the shaft 20, the user locks and secures the flange 40 onto the Gripedo device using one of the hitch pins 26. In this embodiment of the present invention, the user can utilize the Gripedo device for twisting exercise on a flat surface. Additionally, the user can use this embodiment of the present invention as a gymnastic cane. Furthermore, the user can use this embodiment of the present invention for deadlifts, swings, bent over rows, and goblet squats, etc.

In the preferred embodiment of the present invention, the Gripedo device may be used for a plurality of physical exercises. In an embodiment of the present invention, the Gripedo device can be used to do work against sand, rice, or any other suitable granular material. The user pushes the plurality of fins 30 on the shaft 20 into the sand, rice, or any other suitable material in a container. The user then rotates the handle 10 of the Gripedo device with wrist flexion and extension while holding the handle 10 of the Gripedo device. The user can grip the handle 10 and perform wrenching and twisting like exercises by supinating or pronating the wrist, forearm, and work shoulder by internally and externally rotating shoulder. The user can also grip the shaft body 21 and do wrist extension and flexion exercises. The sand, rice, or any other suitable granular material provides resistance and the exercise works the concentric phase, which helps rehabilitation and conditioning. In another embodiment of the present invention, the shaft body 21 of the Gripedo device can be mounted onto a structure with an elevated horizontal cylindrical protrusion through the at least one hole 31 on the plurality of fins 30 using at least one attachment element including, but not limited to, string, rope, cable, chain, or steel wire. The user can further attach at least one weight plate to the attachment element for enhanced exercises. Thus, while the user performs twisting- and wrenching-like motions of supination and pronation of the forearm and wrist by holding the handle 10 of the Gripedo device, the forearm muscles as well other muscles will be exercised. The user can further grip the shaft body 21 and perform wrist extension and flexion exercises.

In another embodiment of the present invention, the Gripedo device with the weight bearing flange 40 detachably attached to the shaft 20 using the hitch pin 26 can be used as a gymnastic cane. The user can insert desired weights or weight plates through the flange connector 42 onto the flange 41 before attaching the weight bearing flange 40 onto the shaft 20 of the Gripedo device. In this gymnastic cane configuration, the weight bearing flange 40 functions as an exercise sled and provides a stable platform. In yet another embodiment of the present invention, the Gripedo device can be detachably attached to an existing standard loading pin to be used as a gymnastic cane. More specifically, this embodiment provides a wobbly platform which gymnastic canes do not offer. This embodiment will provide a more challenging exercise than regular gymnastic canes due to the unbalanced configuration of the Gripedo device. Thus, the present invention provides a much more advanced function than regular gymnastic canes.

In another embodiment of the present invention, the Gripedo device can be used for weight lifting by connecting the Gripedo device to an existing exercise machine, a frame, or a barbell using a common fastener including, but not limited to, a star knob screw through the threaded hole 27 of the present invention. In yet another embodiment of the present invention, the Gripedo device can be used for pull-ups. One common attachment element including, but not limited to, string, rope, cable, chain, or steel wire is attached to one of the plurality of hitch pins 26, which is locked in one of the plurality of holes 24 of the shaft body 21. The attachment element is then secured to an elevated bar of an exercise machine or any secure support frame. The user can hang from the bar by holding the handle 10 or the shaft 20 of at least one Gripedo device to perform regular two-handed pull-ups or single-handed pull-ups. In this configuration, the user can also use the Gripedo device and hang from the Gripedo device using both hands/arms to do pull-ups or isometric holds. With a similar setup, instead of securing the at least one attachment element to an elevated bar, the user attaches the at least one attachment element to weights. The user can then use the Gripedo device to perform, while holding the handle 10 of the Gripedo device or any other handles of the present invention, single-arm deadlifts, farmer's carries, goblet squats, etc. In another embodiment of the present invention, the Gripedo device can be mounted on to the end of a barbell which has the other end inserted in to a landmine trainer. A star knob screw can be used with the threaded hole 27 of the shaft body 21 to secure the Gripedo device to the barbell. The user can perform deadlifts, bent over rows, forward push-press type exercises, Russian twists, etc., while gripping the handle 10 of the Gripedo device. In another embodiment of the present invention, in previous setup with landmine trainer, the Gripedo device can be used to perform therapeutic massages by positioning the handle 10 of the Gripedo device over the muscle the user desires to massage.

In other embodiments of the present invention, the Gripedo device may further be used for Goblet squats, sled applications, exercises using chains, bands, strings, and/or weights. The present invention is versatile with a plurality of exercise uses. The present invention can be stored away in a bag or container and can be safely and comfortably carried to anywhere at any time.

Although the invention has been explained in relation to its preferred embodiment, it is to be understood that many other possible modifications and variations can be made without departing from the spirit and scope of the invention.

What is claimed is:

1. A Gripedo portable and multifunctional exercise device comprising:

a handle;

a shaft;

a plurality of fins;

the shaft comprising a shaft body, a first distal end, and a second distal end;

the handle being terminally connected to the shaft body at the first distal end;

the plurality of fins being terminally positioned on the outer surface of the shaft body;

the plurality of fins being positioned flush with the second distal end of the shaft body;

the shaft being a hollow tube;

the shaft comprising a first opening, a second opening and a plurality of holes;

the first opening being terminally positioned at the first distal end of the shaft body;

the second opening being terminally positioned at the second distal end of the shaft body, opposite the first opening;

the plurality of holes being positioned across the shaft body adjacent the first opening and the second opening;

the plurality of holes traversing through and intercepting the shaft body;

the plurality of fins comprising at least one hole;

the at least one hole being positioned on at least one of the plurality of fins; and the at least one hole traversing through the at least one of the plurality of fins.

2. The Gripedo portable and multifunctional exercise device as claimed in claim 1 comprising:

the shaft comprising a gripping portion;

the gripping portion being concentrically and terminally positioned on the shaft body; and the gripping portion being exteriorly positioned on the shaft body between the first distal end and the second distal end.

3. The Gripedo portable and multifunctional exercise device as claimed in claim 1 comprising:

the shaft comprising a threaded hole; and the threaded hole being terminally and exteriorly positioned on the shaft body between the first opening of the shaft and the plurality of fins the handle comprising a handle body and a handle connector;

the handle connector being a hollow pipe;

the handle connector being terminally connected to the handle body;

the handle connector comprising an opening and a plurality of holes;

the plurality of holes of the handle connector being terminally and exteriorly positioned on the handle connector, adjacent to the opening of the handle connector; and the plurality of holes traversing through and intersecting handle connector.

4. The Gripedo portable and multifunctional exercise device as claimed in claim 3 comprising:

a weight bearing flange;

the weight bearing flange comprising a flange and a flange connector;

the flange connector being a hollow tube;

the flange connector comprising an opening and a plurality of holes;

the flange connector being concentrically and terminally connected to the flange; and the plurality of holes being terminally and exteriorly positioned across the flange connector.

5. The Gripedo portable and multifunctional exercise device as claimed in claim 3 comprising:

the handle body being a ball handle; and the ball handle being terminally and concentrically connected to the handle connector.

6. The Gripedo portable and multifunctional exercise device as claimed in claim 3 comprising:

the handle body being a bar handle;

the bar handle comprising a bar, a base block, and a plurality of support walls;

the bar being terminally connected and oriented perpendicular to the plurality of support walls;

the base block being terminally connected and oriented perpendicular to each of the plurality of support walls; and the base block being terminally connected to the handle connector, which is positioned perpendicular to the base block and opposite the plurality of support walls along the base block.

7. The Gripedo portable and multifunctional exercise device as claimed in claim 3 comprising:

the handle body being a wheel handle;

the wheel handle comprising a ring and a bracket;

the bracket being terminally connected to the ring;

the bracket being positioned within and aligned with the center of the ring; and the bracket being terminally connected to the first opening of the handle connector.

8. The Gripedo portable and multifunctional exercise device as claimed in claim 3 comprising:

the handle body being a rotary bar handle;

the rotary bar handle comprising a plate and a plurality of bars;

the plurality of bars being distributed across and oriented perpendicular to the longitudinal centerline of the plate; and the plate being terminally connected to the handle connector, which is positioned perpendicular to the plate and opposite the plurality of bars.

9. The Gripedo portable and multifunctional exercise device as claimed in claim 3 comprising:

the handle body being a rotary ball handle;

the rotary bar handle comprising a ball, bar and a plurality of shafts;

the ball being concentrically and terminally connected to the plurality of shafts;

the bar being concentrically connected to the plurality of shafts; and the plurality of shafts being terminally connected to the handle connector, which is positioned opposite the ball.

10. The Gripedo portable and multifunctional exercise device as claimed in claim 3 comprising:

the handle body being a hub handle;

the hub handle comprising a hub and a disk plate;

the hub being concentrically and terminally connected to the disk plate; and the disk plate being terminally connected to the handle connector, which is positioned perpendicular to the plate and opposite the hub.

11. The Gripedo portable and multifunctional exercise device as claimed in claim 3 comprising:

the handle body being a dome handle;

the hub handle comprising a dome and a plate;

the dome being centrally and terminally connected to the plate; and the plate being terminally connected to the handle connector, which is positioned perpendicular to the plate and opposite the dome.

12. A Gripedo portable and multifunctional exercise device comprising:
a handle;
a shaft;
a plurality of fins;
the shaft being a hollow tube;
the shaft comprising a shaft body, a first distal end, a second distal end, a first opening, a second opening, a plurality of holes and a threaded hole;
the first opening being terminally positioned at the first distal end of the shaft body;
the second opening being terminally positioned at the second distal end of the shaft body, opposite the first opening;
the plurality of holes being positioned across the shaft body adjacent the first opening and the second opening;
the plurality of holes traversing through and intercepting the shaft body;
the threaded hole being terminally and exteriorly positioned on the shaft body between the first opening of the shaft and the plurality of fins;
the plurality of fins comprising at least one hole;
the at least one hole being positioned on at least one of the plurality of fins;
the at least one hole traversing through the at least one of the plurality of fins;
the handle comprising a handle body and a handle connector;
the handle connector being a hollow pipe;
the handle connector being terminally connected to the handle body;
the handle connector comprising an opening and a plurality of holes;
the plurality of holes of the handle connector being terminally and exteriorly positioned on the handle connector, adjacent to the opening of the handle connector; and
the plurality of holes traversing through and intersecting handle connector.

13. The Gripedo portable and multifunctional exercise device as claimed in claim 12 comprising:
a weight bearing flange;
the weight bearing flange comprising a flange and a flange connector;
the flange connector being a hollow tube;
the flange connector comprising an opening and a plurality of holes;
the flange connector being concentrically and terminally connected to the flange;
the flange connector being concentrically and terminally connected to the flange; and
the plurality of holes being terminally and exteriorly positioned across the flange connector.

14. The Gripedo portable and multifunctional exercise device as claimed in claim 12 comprising:
the handle body being a ball handle; and
the ball handle being terminally and concentrically connected to the handle connector.

15. The Gripedo portable and multifunctional exercise device as claimed in claim 12 comprising:
the handle body being a bar handle;
the bar handle comprising a bar, a base block, and a plurality of support walls;
the bar being terminally connected and oriented perpendicular to the plurality of support walls;
the base block being terminally connected and oriented perpendicular to each of the plurality of support walls; and
the base block being terminally connected to the handle connector, which is positioned perpendicular to the base block and opposite the plurality of support walls along the base block.

16. The Gripedo portable and multifunctional exercise device as claimed in claim 12 comprising:
the handle body being a wheel handle;
the wheel handle comprising a ring and a bracket;
the bracket being terminally connected to the ring;
the bracket being positioned within and aligned with the center of the ring; and
the bracket being terminally connected to the first opening of the handle connector.

17. The Gripedo portable and multifunctional exercise device as claimed in claim 12 comprising:
the handle body being a rotary bar handle;
the rotary bar handle comprising a plate and a plurality of bars;
the plurality of bars being distributed across and oriented perpendicular to the longitudinal centerline of the plate; and
the plate being terminally connected to the handle connector, which is positioned perpendicular to the plate and opposite the plurality of bars.

18. The Gripedo portable and multifunctional exercise device as claimed in claim 12 comprising:
the handle body being a rotary ball handle;
the rotary bar handle comprising a ball, bar and a plurality of shafts;
the ball being concentrically and terminally connected to the plurality of shafts;
the bar being concentrically connected to the plurality of shafts; and
the plurality of shafts being terminally connected to the handle connector, which is positioned opposite the ball.

19. The Gripedo portable and multifunctional exercise device as claimed in claim 12 comprising:
the handle body being a hub handle;
the hub handle comprising a hub and a disk plate;
the hub being concentrically and terminally connected to the disk plate; and
the disk plate being terminally connected to the handle connector, which is positioned perpendicular to the plate and opposite the hub.

20. The Gripedo portable and multifunctional exercise device as claimed in claim 12 comprising:
the handle body being a dome handle;
the hub handle comprising a dome and a plate;
the dome being centrally and terminally connected to the plate; and
the plate being terminally connected to the handle connector, which is positioned perpendicular to the plate and opposite the dome.

* * * * *